US011066948B2

(12) United States Patent
Matsumoto

(10) Patent No.: US 11,066,948 B2
(45) Date of Patent: Jul. 20, 2021

(54) ROTARY MACHINE

(71) Applicant: MITSUBISHI HEAVY INDUSTRIES, LTD., Tokyo (JP)

(72) Inventor: Kazuyuki Matsumoto, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 16/270,748

(22) Filed: Feb. 8, 2019

(65) Prior Publication Data

US 2019/0277153 A1 Sep. 12, 2019

(30) Foreign Application Priority Data

Mar. 9, 2018 (JP) ..... JP2018-043509

(51) Int. Cl.
*F01D 17/14* (2006.01)
*F01D 5/14* (2006.01)
*F01D 5/30* (2006.01)

(52) U.S. Cl.
CPC ..... *F01D 17/145* (2013.01); *F01D 5/145* (2013.01); *F01D 5/147* (2013.01); *F01D 5/3061* (2013.01)

(58) Field of Classification Search
CPC .. F01D 17/145; F01D 17/147; F01D 17/3061; F01D 25/04; F01D 11/06; F01D 11/10; F01D 21/003; F01D 11/02
See application file for complete search history.

(56) References Cited

U.S. PATENT DOCUMENTS 3,572,960 A * 3/1971 McBride ..... F04D 29/684 415/115
4,255,083 A * 3/1981 Andre ..... F02C 7/045 181/206
4,311,431 A * 1/1982 Barbeau ..... F01D 5/225 415/116
5,141,391 A * 8/1992 Acton ..... F01D 17/02 415/119
6,055,805 A * 5/2000 El-Aini ..... F01D 5/10 60/226.1

(Continued)

FOREIGN PATENT DOCUMENTS

EP 2 372 105 10/2011
JP 58-092402 6/1983

(Continued)

*Primary Examiner* — Justin D Seabe
*Assistant Examiner* — Ryan C Clark
(74) *Attorney, Agent, or Firm* — Wenderoth, Lind & Ponack, L.L.P.

(57) ABSTRACT

There is provided a rotary machine including a rotary shaft; a plurality of rotor blades extending outward from the rotary shaft in a radial direction of the rotary shaft, and are provided with gaps therebetween in a peripheral direction of the rotary shaft; a casing surrounding the rotor blades radially outside the rotor blades, and in which a recessed portion as a cavity accommodates tips of the rotor blades; a sealing portion extending from one of a bottom surface of the recessed portion and the tip of the rotor blade, and having a clearance with the other; a jet flow passage through which a fluid is jetted rearward in a rotation direction of the rotary shaft in the cavity; and a valve which is capable of switching a flow condition of the jet flow with turning the valve on an opening state and a closing state.

6 Claims, 7 Drawing Sheets

(56) References Cited

U.S. PATENT DOCUMENTS

| | | | | |
|---|---|---|---|---|
| 6,125,626 | A * | 10/2000 | El-Aini | F01D 5/10 60/226.1 |
| 6,409,465 | B1 * | 6/2002 | von Flotow | F01D 5/145 415/1 |
| 7,967,556 | B2 * | 6/2011 | Gummer | F04D 29/563 415/144 |
| 10,316,692 | B2 * | 6/2019 | Yoshida | F02B 39/10 |
| 2010/0189542 | A1 | 7/2010 | Maltson | |
| 2016/0047265 | A1 | 2/2016 | Matsumoto et al. | |
| 2018/0128342 | A1 * | 5/2018 | Ghosh | F16F 9/535 |
| 2019/0063747 | A1 * | 2/2019 | Mollmann | F02C 9/00 |

FOREIGN PATENT DOCUMENTS

| | | |
|---|---|---|
| JP | 60-056863 | 4/1985 |
| JP | 63-205404 | 8/1988 |
| JP | 2006-104952 | 4/2006 |
| JP | 2007-120476 | 5/2007 |
| JP | 2010-159667 | 7/2010 |
| JP | 2013-076341 | 4/2013 |
| JP | 2014-141912 | 8/2014 |
| JP | 2015-048771 | 3/2015 |
| JP | 2017-115716 | 6/2017 |
| WO | 2014/162767 | 10/2014 |

* cited by examiner

ROTARY MACHINE

BACKGROUND OF THE INVENTION

Field of the Invention

The present invention relates to a rotary machine.

Priority is claimed on Japanese Patent Application No. 2018-043509, filed on Mar. 9, 2018, the content of which is incorporated herein by reference.

Description of Related Art

A steam turbine includes a rotor that rotates around an axis; a plurality of rotor blades attached to the rotor; a casing that covers the rotor and the rotor blades from the outside; and a plurality of stator blades attached to an inner surface of the casing. High-temperature and high-pressure steam flows into the steam turbine from one side in an axial direction, and thus energy is applied to the rotor blades, and a rotary shaft rotates. A generator or the like connected with the steam turbine is driven by the rotational energy.

In such the steam turbine, typically, a predetermined clearance is provided between a tip portion (shroud) of the rotor blade and an inner peripheral surface of the casing to allow smooth rotation of the rotor. Because steam flowing through the clearance flows downstream without colliding with the rotor blades or the stator blades, the steam does not contribute to the rotation of the rotor. The steam flowing through the clearance contains swirl components (speed components in a peripheral direction). A pressure distribution in the clearance becomes non-uniform due to such the swirl components, and as a result, vibration may occur in the rotor. Therefore, technology of decreasing the swirl components is desirable.

Japanese Unexamined Patent Application, First Publication No. 2006-104952 discloses an apparatus as an example of such technology. In the apparatus, a guiding blade for guiding a flow direction of steam is provided in a nozzle portion of the stator blade positioned upstream of the shroud of the rotor blade. It is possible to decrease the swirl components, and restrict vibration of the rotor by virtue of the guiding blade.

SUMMARY OF THE INVENTION

It is known that leakage steam containing swirl components promotes (assists) the rotation of the rotor by virtue of frictional force occurring between the rotor and the leakage steam. In the configuration of the apparatus disclosed in Japanese Unexamined Patent Application, First Publication No. 2006-104952, vibration of the rotor can be restricted, and on the other hand, the frictional force also decreases along with the decreasing of swirl components. As a result, a force to rotate the rotor in the peripheral direction becomes weak, and an output of the turbine further decreases compared to when no guiding blades are provided. Therefore, the apparatus is desirably capable of decreasing swirl components only when vibration occurs in the rotor.

The present invention has been made to solve the problem, and an object of the present invention is to provide a rotary machine in which vibration and an output decrease are restricted.

Solution to the Problem

According a first aspect of the present invention, there is provided a rotary machine including a rotary shaft configured to rotate around an axis; a plurality of rotor blades extending outward from the rotary shaft in a radial direction of the rotary shaft and are provided with gaps therebetween in a peripheral direction of the rotary shaft; a casing surrounding the rotor blades radially outside the rotor blades, and in which a recessed portion as a cavity accommodates tips of the rotor blades; a sealing portion extending from one of a bottom surface of the recessed portion and the tip of the rotor blade, and having a clearance with the other; a jet flow passage through which a fluid is jetted rearward in a rotation direction of the rotary shaft in the cavity; and a valve which is capable of switching a flow condition of the jet flow passage with turning the valve on an opening state and a closing state.

According to the configuration, when the valve is in the opening state, it is possible to decrease and restrict a swirl component inside the recessed portion by virtue of a fluid jetted out of the jet flow passage. On the other hand, when the valve is in the closing state, because the swirl component pulls the tip of the rotor blade in the rotation direction when the swirl component smoothly flows inside the recessed portion, it is possible to recover part of the energy of the swirl component as a rotational energy of a rotor. That is, according to the configuration, when vibration occurs in the rotary shaft, it is possible to jet the minimum amount of fluid out of the jet flow passage, which is required to allow the vibration to converge. Therefore, it is possible to restrict vibration caused by the swirl component while minimizing an output decrease of the steam turbine.

According to a second aspect of the present invention, the jet flow passage may extend rearward in the rotation direction of the rotary shaft along with the jet flow passage moves on from one side to the other side in a direction of the axis, and a first end of the jet flow passage may be opened, in a recessed portion upstream surface which is positioned upstream side of the recessed portion.

The swirl component is formed inside the recessed portion such that the swirl component flows frontward in the rotation direction as travelling from one side to the other side in the axial direction along with the rotation of the rotary shaft. In the configuration, the fluid jetted out of the first end of the jet flow passage flows rearward in the rotation direction as travelling from one side to the other side in the axial direction. That is, the fluid is jetted out of the jet flow passage in a direction intersecting a flow direction of the swirl component. Therefore, it is possible to decrease the swirl component.

According to a third aspect of the present invention, the jet flow passage may extend rearward in the rotation direction of the rotary shaft and from the outside to an inside in the radial direction, and a first end of the jet flow passage may open in the bottom surface of the recessed portion.

The swirl component is formed inside the recessed portion such that the swirl component flows frontward in the rotation direction as travelling from one side to the other side in the axial direction along with the rotation of the rotary shaft. In the configuration, the fluid jetted out of the first end of the jet flow passage flows rearward in the rotation direction as travelling from the outside to the inside in the radial direction. That is, the fluid is jetted out of the jet flow passage in a direction intersecting a flow direction of the swirl component. Therefore, it is possible to decrease the swirl component.

According to a fourth aspect of the present invention, a plurality of the recessed portions may be formed in the casing so as to be arranged spaced from each other in the axial direction, and a second end of the jet flow passage may be opened one of a pair of the recessed portions adjacent to each other, which is positioned on the one side in the axial direction, along with the first end of the jet flow passage may be opened in the other of the recessed portions, which is positioned on the other side in the axial direction.

In the steam turbine, high-pressure steam is supplied from one side in the axial direction. For this reason, the closer a portion of the recessed portion is positioned to one side in the axial direction, the higher a pressure of flowing steam is. In the configuration, between the pair of the recessed portions adjacent to each other, high-pressure steam in the recessed portion on one side in the axial direction can be jetted to the recessed portion on the other side in the axial direction via the jet flow passage. That is, it is not necessary to provide a separate pressure source or the like for the jetting of the fluid out of the jet flow passage. Therefore, it is possible to simplify the configuration of the apparatus.

According to a fifth aspect of the present invention, the rotary machine may further include a vibration detection unit configured to detect vibration of the rotary shaft; and a control device configured to switch the valve on the opening state when the vibration of the rotary shaft is detected by the vibration detection unit and to maintain the valve on the closing state when the vibration of the rotary shaft is not detected.

According to the configuration, when vibration of the rotary shaft is detected, it is possible to decrease the swirl component, and restrict the vibration by switching the valve on the opening state. When the vibration converges, it is possible to restrict an output decrease of the steam turbine by maintaining the valve on the closing state. That is, it is possible to further restrict an output decrease of the steam turbine compared to when swirl breakers or the like are provided.

According to a sixth aspect of the present invention, a plurality of the jet flow passages and a plurality of the valves may be provided while being equally spaced from each other in the peripheral direction with respect to the axis.

According to the configuration, because the plurality of jet flow passages and the plurality of valves are provided while being equally spaced from each other in the peripheral direction, even though all of the valves are in the opening state, the fluid is equally supplied from the jet flow passages in the peripheral direction. For this reason, it is possible to eliminate a pressure unbalance which is caused by an offset between fluid-jet positions, and achieve a uniform peripheral pressure distribution inside the casing. That is, it is possible to restrict an unstable vibration or the like caused by a non-uniform peripheral pressure distribution inside the casing.

According to a seventh aspect of the present invention, the rotary machine may further include a vibration detection unit configured to detect vibration of the rotary shaft; and a control device configured to switch the valve on the opening state when the vibration of the rotary shaft is detected by the vibration detection unit and to maintain the valve on the closing state when the vibration of the rotary shaft is not detected. The control device may determine the number of the valves, which are to be switched on the opening state, in response to an intensity of vibration of the rotary shaft.

According to the configuration, the number of the valves, which are to be switched on the opening state, is determined in response to the intensity of vibration of the rotary shaft. That is, when the intensity of vibration is high, it is possible to switch a larger number of the valves on the opening state. Therefore, it is possible to allow the vibration to early converge. On the other hand, when the intensity of vibration is low, it is possible to allow vibration to converge while minimizing an output decrease of the steam turbine by switching the minimum number of the valves on the opening state.

According to an eighth aspect of the present invention, the control device may increase the number of the valves which is turned on the opening state with the increasing of the intensity of vibration of the rotary shaft, and turns the valves on the opening state such that a plurality of the jet flow passages, which are in opening conditions, are equally spaced from each other in the peripheral direction.

According to the configuration, when the intensity of vibration is high, it is possible to switch a larger number of the valves on the opening state. Therefore, it is possible to allow the vibration to early converge. Because the jet flow passages corresponding to the valves in the opening state are disposed while being equally spaced from each other in the peripheral direction, it is possible to eliminate a pressure unbalance which is caused by an offset between fluid-jet positions, and achieve a uniform peripheral pressure distribution inside the casing. That is, it is possible to restrict an unstable vibration or the like caused by a non-uniform peripheral pressure distribution inside the casing.

According to the present invention, it is possible to provide a rotary machine in which vibration is restricted and an output decrease is minimized.

DETAILED DESCRIPTION OF THE INVENTION

First Embodiment

Figure 1:
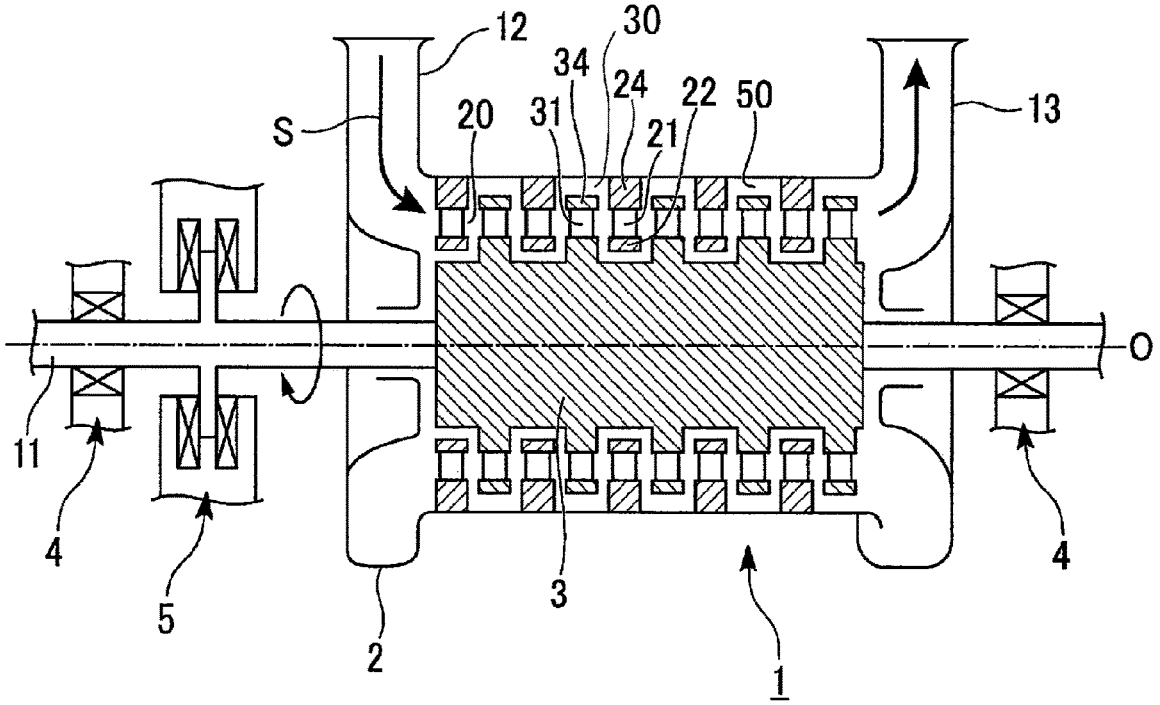
FIG. 1 is a view showing a configuration of a steam turbine according to a first embodiment of the present invention.

A first embodiment of the present invention will be described with reference to the drawings. As shown in FIG.

1, a steam turbine 1 includes a rotor (rotary shaft) 3 which extends along the direction of an axis O; a casing 2 which covers the rotor 3 from an outer peripheral side; journal bearings 4 which support shaft ends 11 of the rotor 3 such that the rotor 3 can rotate around the axis O; and a thrust bearing 5.

The rotor 3 has a plurality of rotor blades 30. The plurality of rotor blades 30 are arranged with predetermined gaps therebetween in a peripheral direction of the rotor 3. A plurality of rows of the rotor blades 30 are arranged with predetermined gaps therebetween even in the direction of the axis O. The rotor blade 30 has a blade body 31 and a rotor blade shroud (shroud) 34. The blade body 31 protrudes outward from an outer peripheral surface of the rotor 3 in a radial direction. The blade body 31 has a blade-shaped cross section as seen in the radial direction. The rotor blade shroud 34 is provided in a tip portion (outer end portion in the radial direction) of the blade body 31.

The casing 2 has a substantially cylindrical shape and covers the rotor 3 from the outer peripheral side. A steam supply pipe 12 for suctioning steam is provided on one side of the casing 2 in the direction of the axis O. A steam exhaust pipe 13 for exhausting steam is provided on the other side of the casing 2 in the direction of the axis O. In the description hereinbelow, an upstream side refers to a side where the steam supply pipe 12 is positioned in the viewpoint of the steam exhaust pipe 13. A downstream side refers to a side where the steam exhaust pipe 13 is positioned in the viewpoint of the steam supply pipe 12.

A plurality of stator blades 21 are provided along an inner peripheral surface of the casing 2. The stator blade 21 is a blade-shaped member that is connected to the inner peripheral surface of the casing 2 via a stator blade base 24. A stator blade shroud 22 is provided in a tip portion (inner end portion in the radial direction) of the stator blade 21. Similar to the rotor blade 30, the plurality of stator blades 21 are arranged on the inner peripheral surface along the peripheral direction and the direction of the axis O. The rotor blade 30 is disposed in a region between the plurality of stator blades 21 adjacent to each other.

A main flow passage 20 is formed by a region in which the stator blades 21 and the rotor blades 30 are arranged inside the casing 2, and steam S which is a working fluid flows through the main flow passage 20. A recessed portion 50 is formed in the entire peripheral region between the inner peripheral surface of the casing 2 and the rotor blade shrouds 34, and is recessed outward in the radial direction with respect to the axis O. The recessed portion 50 forms a cavity that accommodates tips (rotor blade shrouds 34) of the rotor blades 30. That is, the recessed portion 50 has a sufficiently large volume compared to the volume of the rotor blade shrouds 34.

The steam S is supplied to the steam turbine 1 with the foregoing configuration via the steam supply pipe 12 on the upstream side. Thereafter, as the rotor 3 rotates, the steam S passes through the rows of the stator blades 21 and the rotor blades 30, and shortly thereafter, is exhausted to a subsequent apparatus (not shown) via the steam exhaust pipe 13 on the downstream side. The steam S also flows into the recessed portions 50 when passing through the rows of the stator blades 21 and the rotor blades 30.

The journal bearings 4 support a load applied in the radial direction with respect to the axis O. The journal bearings 4 are respectively provided at both ends of the rotor 3. The thrust bearing 5 supports a load applied in the direction of the axis O. The thrust bearing 5 is provided in only an upstream end portion of the rotor 3.

Figure 2:
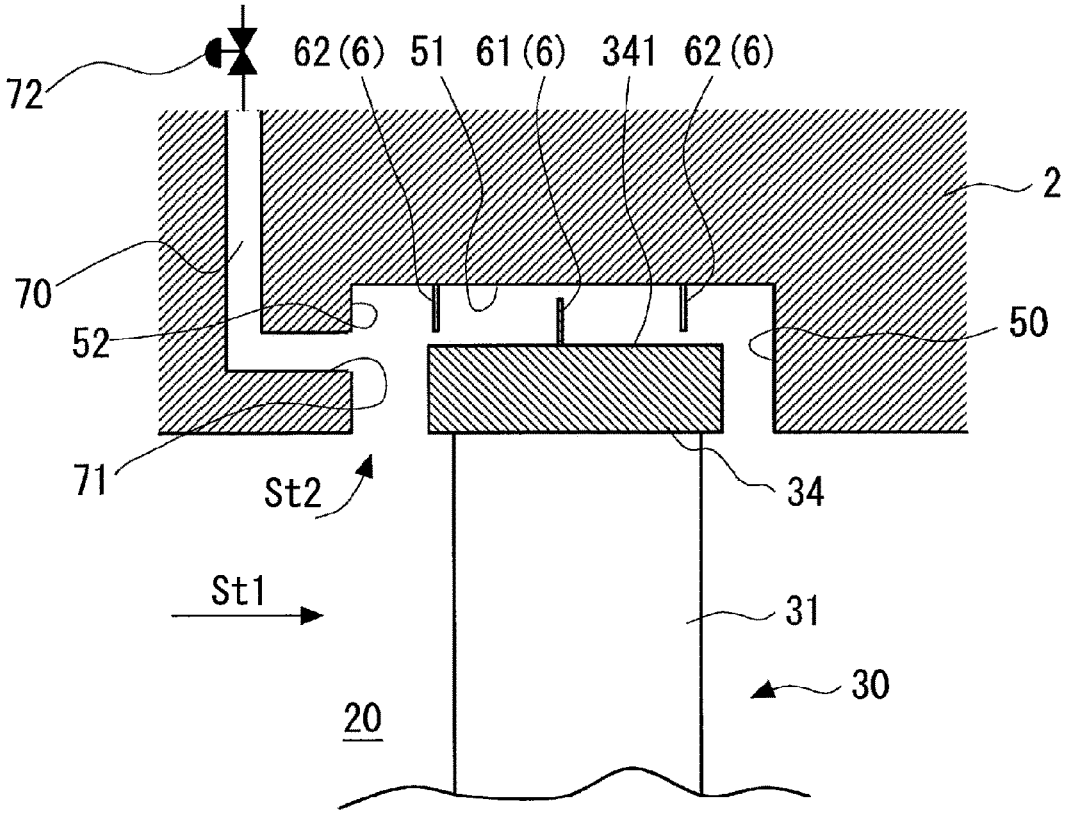
FIG. 2 is an enlarged view of a jet flow passage according to the first embodiment of the present invention.

FIG. 2 shows the periphery of the recessed portion 50 in an enlarged manner. A sealing fin 6 is provided on at least one of a tip (shroud outer peripheral surface 341) of the rotor blade shroud 34 and a surface (which faces an inner peripheral side) (recessed portion bottom surface 51) of the recessed portion 50 and between the shroud outer peripheral surface 341 and the recessed portion bottom surface 51, and protrudes to the other. The sealing fin 6 is provided to prevent a flow (leakage flow St2) of steam from diverging from steam (main steam St1) flowing through the main flow passage 20, and from flowing to the recessed portion 50.

In the embodiment, one sealing fin 6 (shroud side sealing fin 61) is provided on the shroud outer peripheral surface 341, and two sealing fins 6 (recessed portion side sealing fins 62) are provided on the recessed portion bottom surface 51. The shroud side sealing fin 61 is disposed between two recessed portion side sealing fins 62. Small gaps (clearances) widening in the radial direction are formed between the shroud side sealing fin 61 and the recessed portion bottom surface 51 and between the recessed portion side sealing fins 62 and the shroud outer peripheral surface 341.

Figure 3:
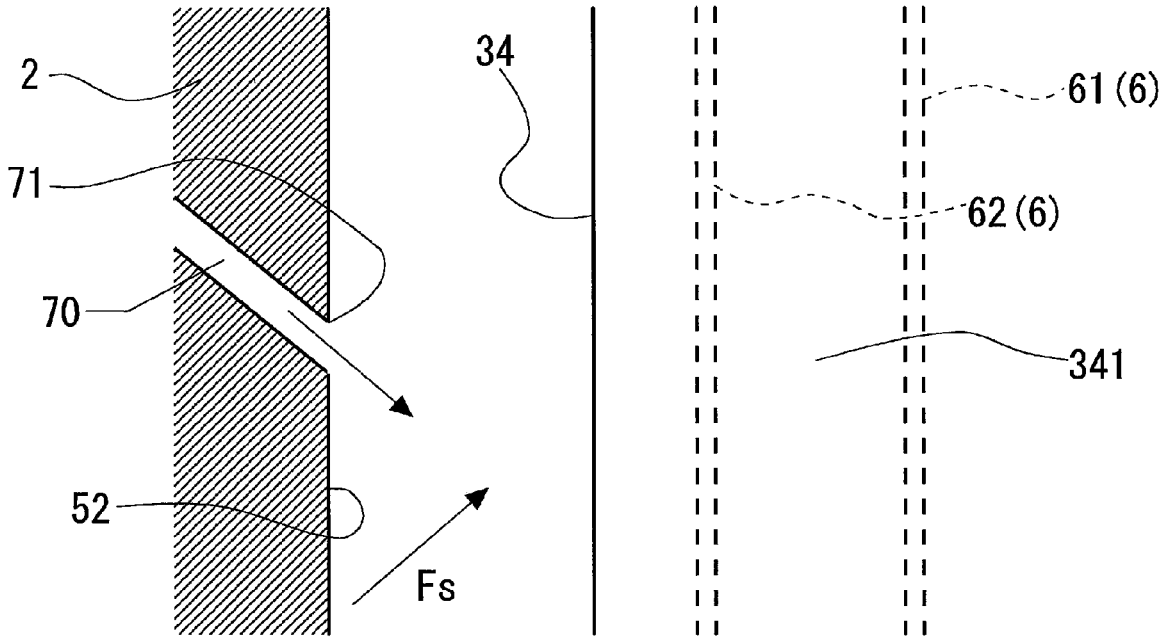
FIG. 3 is a view of the jet flow passage according to the first embodiment of the present invention as seen in a radial direction.

The jet flow passage 70 is a flow passage that connects together the inside and the outside of the casing 2. As shown in FIGS. 2 and 3, a first end (jet outlet 71) of the jet flow passage 70 opens in a surface (recessed portion upstream surface 52) of the recessed portion 50, which is positioned upstream. In the embodiment, the jet outlet 71 is positioned to overlap the rotor blade shroud 34 in the radial direction with respect to the axis O. As shown in FIG. 3, the first end of the jet flow passage 70, which contains the jet outlet 71, extends rearward in a rotation direction of the rotor 3 and from the upstream side to the downstream side.

A valve 72 is provided at the second end of the jet flow passage 70. The valve 72 switches a flow condition of the jet flow passage 70 via switching between an opening state and a closing state. Specifically, the valve 72 is an electromagnetic valve, and is connected with a control device 90 which will be described later. The second end portion of the jet flow passage 70 extends in the radial direction with respect to the axis O. A fluid (steam, air, or the like) supplied from a supply source (not shown) flows through the jet flow passage 70.

Figure 4:
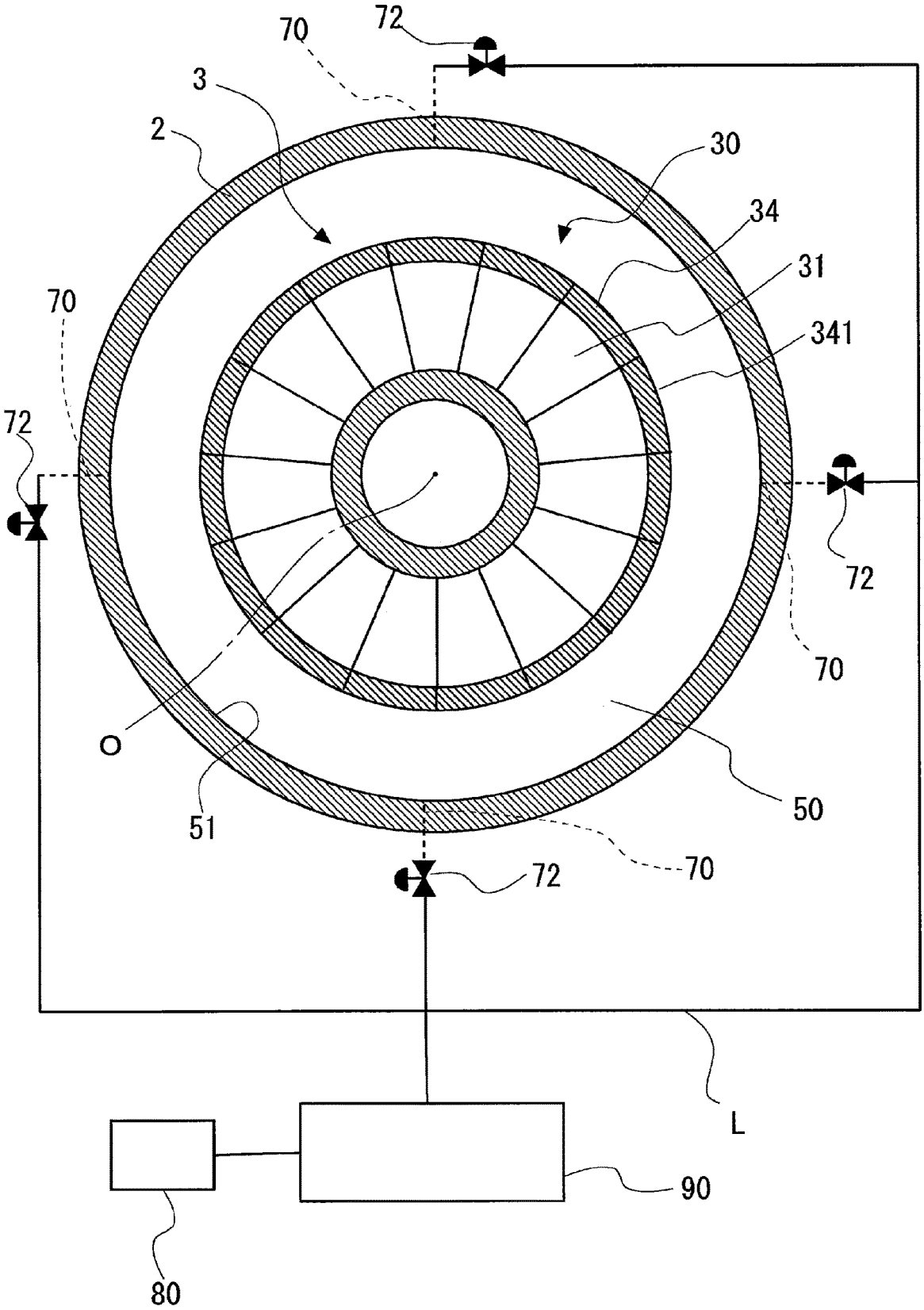
FIG. 4 is a cross-sectional view of the steam turbine according to the first embodiment of the present invention as seen in an axial direction.

In the embodiment, as shown in FIG. 4, a plurality of (four) the jet flow passages 70 are provided inside the recessed portion 50 while being equally spaced from each other in the peripheral direction (FIG. 4 shows the rotor blades 30 in a simplified manner. That is, the number of the rotor blades 30 is not limited to the number in the example shown in FIG. 4). The valve 72 corresponding to each of the jet flow passages 70 is connected with the control device 90 via a signal line L. The steam turbine 1 is provided with a vibration sensor 80 that detects vibration of the rotor 3. Specifically, the vibration sensor 80 is attached to the journal bearing 4 or the thrust bearing 5. The vibration sensor 80 transmits the detected vibration of the rotor 3 to the control device 90 as electrical signals.

Figure 5:
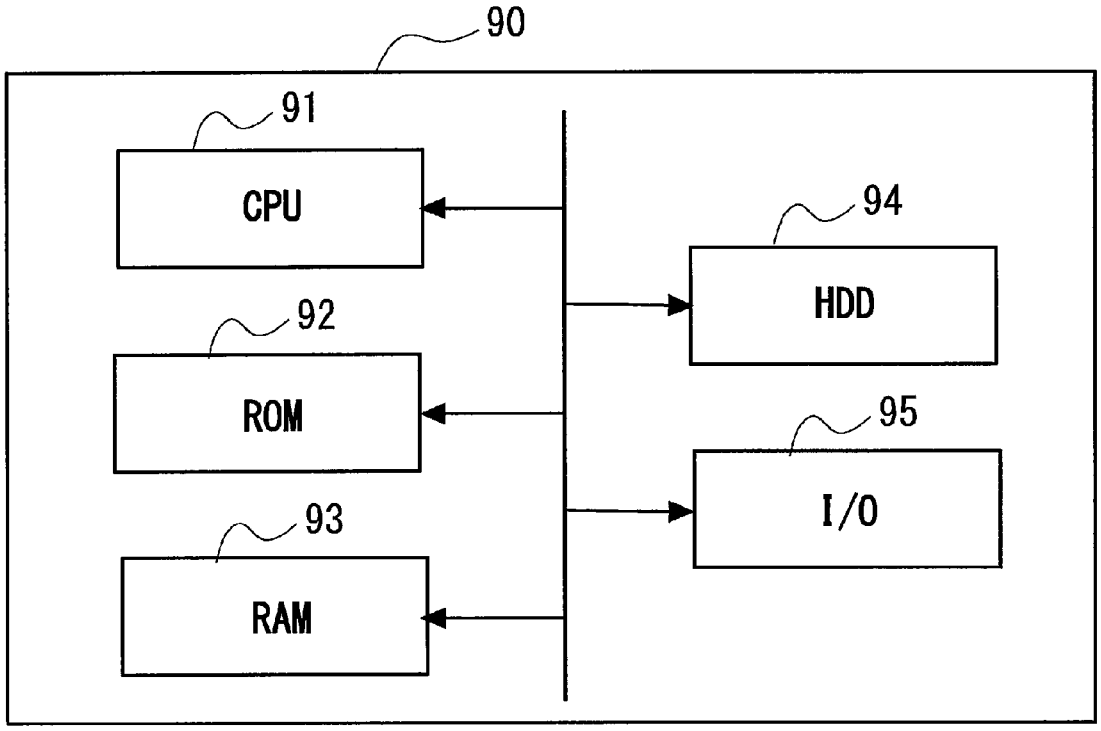
FIG. 5 is a diagram showing a hardware configuration of a control device according to the first embodiment of the present invention.

As shown in FIG. 5, the control device 90 is a computer including a central processing unit (CPU) 91, a read only memory (ROM) 92, a random access memory (RAM) 93, a hard disk drive (HDD) 94, and a signal receiving module (input/output: I/O) 95. The signal receiving module 95 receives signals from the vibration sensor 80. The signal receiving module 95 may receive signals amplified via a charge amplifier or the like.

Figure 6:
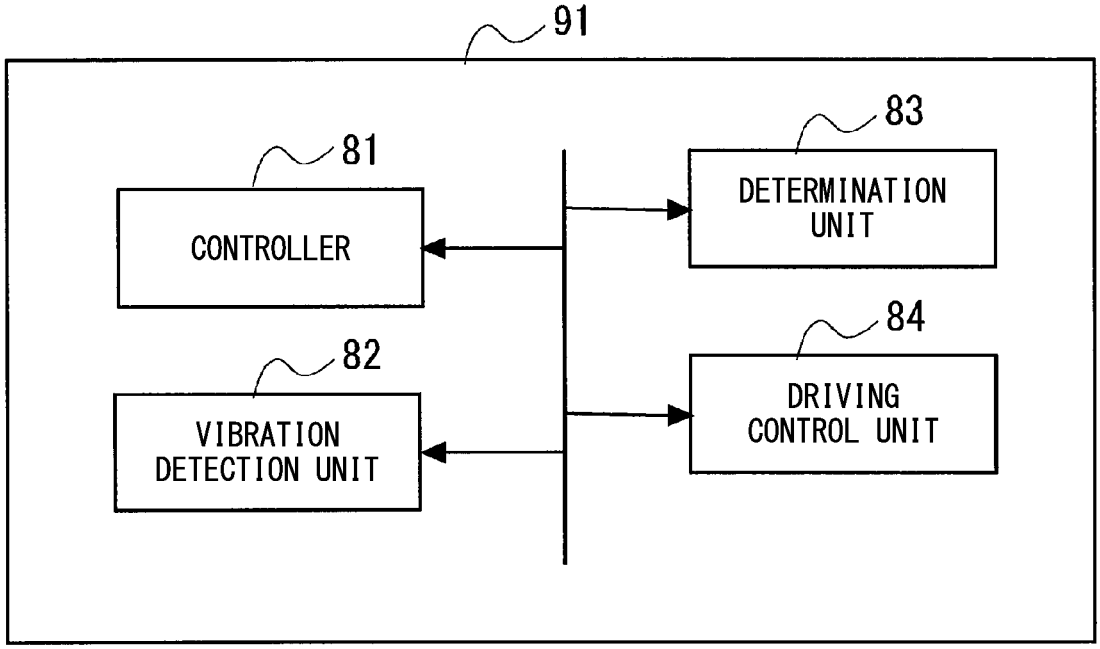
FIG. 6 is a functional block diagram showing a configuration of the control device according to the first embodiment of the present invention.

As shown in FIG. 6, the CPU 91 of the control device 90 executes a program prestored in the device, and has a controller 81, a vibration detection unit 82; a determination unit 83, and a driving control unit 84. The controller 81 controls other functional units of the control device 90. The vibration detection unit 82 receives information (amplitude, frequency, and the like) on the vibration of the rotor 3, which is received from the vibration sensor 80 via the signal receiving module. The determination unit 83 determines whether the vibration of the rotor 3 is greater than a prestored threshold value. The driving control unit 84 transmits drive signals to a driving source of the valve 72 based on the determination result of the determination unit 83. The valve 72 switches between the opening state and the closing state via the drive signals.

Subsequently, an operation of the steam turbine 1 according to the embodiment will be described. In the operation of the steam turbine 1, high-temperature and high-pressure steam is supplied from an outside steam supply source (not shown) to the inside (the main flow passage 20) of the casing 2 via the steam supply pipe 12. The steam forms a flow (the main steam St1) flowing along the main flow passage 20 from the upstream side to the downstream side. The main steam St1 passes through the main flow passage 20 where the stator blades 21 and the rotor blades 30 are provided, thereby imparting rotation force to the rotor 3 via the rotor blades 30. The rotation of the rotor 3 is taken out from a shaft end, and drives external equipment such as a generator (not shown).

Subsequently, a behavior of steam in the vicinity of the recessed portion 50 will be described with reference to FIG. 2. As shown in the same drawing, some components of the main steam St1 forms a flow (the leakage flow St2) that deviates from the main steam St1 and flows into the recessed portion 50. The leakage flow St2 contains a swirl component (swirling flow component) Fs that is imparted when the leakage flow St2 passes through the surroundings of the stator blades 21 provided on the casing 2. As shown in FIG. 3, the swirl component Fs flows frontward (from one side to the other side in the peripheral direction) in the rotation direction of the rotor 3 as travelling from the upstream side to the downstream side.

Figure 7A:
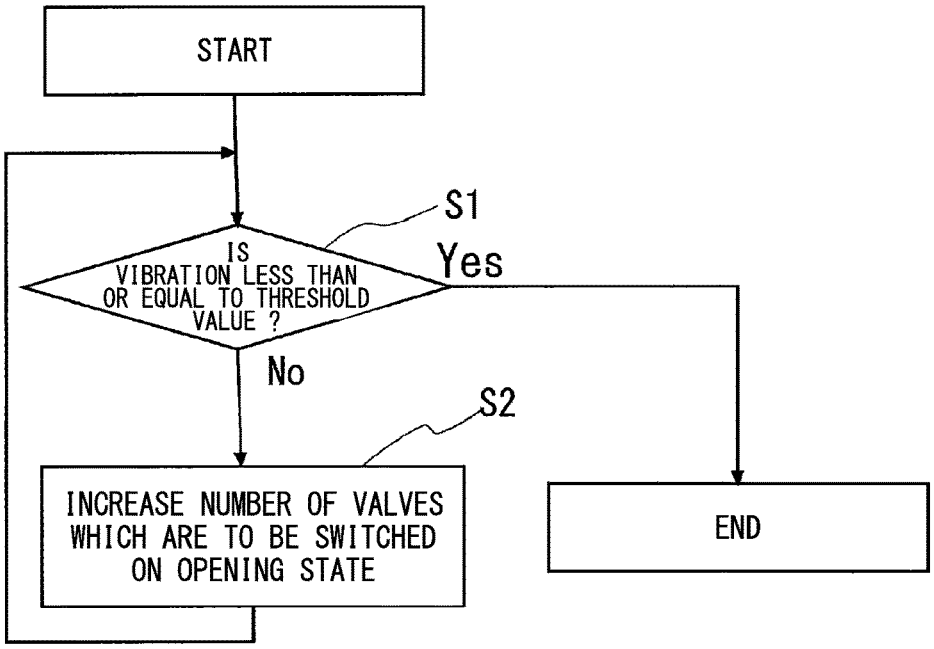
FIG. 7A is a flowchart showing a process performed by the control device according to the first embodiment of the present invention.

As shown in FIG. 7A, when the steam turbine 1 operates, the determination unit 83 performs a comparison in magnitude between the vibration of the rotor 3 and the threshold value (Step S1). When the determination unit 83 determines that the vibration of the rotor 3 is greater than the threshold value (Step S1: No), the driving control unit 84 transmits drive signals to the driving source of the valve 72. The valve 72 enters the opening state via the drive signals, and the jet flow passage 70 opens (Step S2). That is, the fluid is jetted out of the jet outlet 71 of the jet flow passage 70. Therefore, the swirl component Fs of the leakage flow St2 flowing inside the recessed portion 50 decreases, and the vibration of the rotor 3 is restricted.

On the other hand, when the determination unit 83 determines that the vibration of the rotor 3 is less than the threshold value (Step S1: Yes), the driving control unit 84 ends the control without transmitting drive signals to the valve 72. Even thereafter, Steps S1 and S2 are repeatedly executed continuously or intermittently, and thus the vibration of the rotor 3 is monitored.

It is known that the leakage flow St2 containing the swirl component Fs promotes (assists) the rotation of the rotor 3 by virtue of frictional force occurring between the rotor 3 and the leakage flow St2. In the configuration, the vibration of the rotor 3 can be restricted, and on the other hand, the frictional force also decreases along with the decreasing of the swirl component Fs. As a result, a force to rotate the rotor 3 in the peripheral direction may become weak, and an output of the steam turbine 1 may decrease.

In response to the intensity (magnitude in the amplitude of frequency components which may cause an unstable vibration of the rotor) of vibration of the rotor 3, the control device 90 according to the embodiment determines the number of the valves 72 which enter the opening state. Specifically, the driving control unit 84 switches two of four valves 72 on the opening state at an initial stage of detection of vibration. The valves 72, which are switched on the opening state, are a pair of the valves 72 that face each other in a diameter direction with respect to the axis O. That is, the valves 72 in the opening state are equally spaced from each other inside the recessed portion 50 in the peripheral direction.

In this state, the determination unit 83 compares a vibration intensity of the rotor 3 with the threshold value again. When it is determined that the vibration intensity of the rotor 3 is still greater than the threshold value, the remaining two valves 72 are switched on the opening state. That is, four jet flow passages 70 enter the opening state while being equally spaced from each other in the peripheral direction. As such, in the embodiment, as the intensity of vibration of the rotor 3 increases, the number of the jet flow passages 70 to be opened increases.

Even thereafter, the determination unit 83 continuously or intermittently repeats a comparison in magnitude between the vibration intensity and the threshold value. When it is determined that the vibration intensity of the rotor 3 is less than the threshold value, the driving control unit 84 switches two of the valves 72 on the closing state, which face each other in the diameter direction. When it is determined that the vibration intensity of the rotor 3 is still less than the threshold value, the driving control unit 84 switches the remaining two valves 72 on the closing state.

As described above, in the steam turbine 1 according to the embodiment, when the valve 72 is in the opening state, it is possible to decrease and restrict the swirl component Fs inside the recessed portion 50 by virtue of the fluid jetted out of the jet flow passage 70. On the other hand, when the valve 72 is in the closing state, because the swirl component Fs smoothly flows inside the recessed portion 50, the swirl component Fs pulls the tip of the rotor blade 30 in the rotation direction. Therefore, it is possible to recover part of the energy of the swirl component as a rotational energy of the rotor. That is, according to the configuration, it is possible to jet the fluid out of the jet flow passage 70 when vibration occurs in the rotor 3, and it is possible to prevent the jetting of the fluid when vibration converges. Therefore, it is possible to restrict vibration caused by the swirl component Fs while minimizing an output decrease of the steam turbine 1.

Particularly, the swirl component Fs is formed inside the recessed portion 50 such that the swirl component Fs flows frontward in the rotation direction as travelling from one side to the other side in the direction of the axis O along with the rotation of the rotor 3. In the configuration, the fluid jetted out of the first end (the jet outlet 71) of the jet flow passage 70 flows rearward in the rotation direction as travelling from one side to the other side in the direction of the axis O. That is, the fluid is jetted out of the jet flow passage 70 in a direction intersecting a flow direction of the swirl component Fs. Therefore, it is possible to effectively decrease the swirl component Fs.

According to the configuration, when vibration of the rotor 3 is detected, it is possible to decrease the swirl component Fs, and restrict the vibration by switching the valve 72 on the opening state. When the vibration converges, it is possible to minimize the output of the steam turbine 1 by switching the valve 72 on the closing state. That is, it is possible to further restrict an output decrease of the steam turbine 1 compared to when fixed swirl breakers or the like are provided.

According to the configuration, because the plurality of jet flow passages 70 and the plurality of valves 72 are provided while being equally spaced from each other in the peripheral direction, even though all of the valves 72 are in the opening state, the fluid is equally supplied from the jet flow passages 70 in the peripheral direction. For this reason, it is possible to achieve a uniform peripheral pressure distribution inside the casing 2. That is, it is possible to restrict an unstable vibration or the like caused by a non-uniform peripheral pressure distribution inside the casing 2.

According to the configuration, the number of the valves 72, which are to be switched on the opening state, is determined in response to the intensity of vibration of the rotor 3. That is, when the intensity of vibration is high, it is possible to switch a larger number of the valves 72 on the opening state. Therefore, it is possible to allow the vibration to early converge. On the other hand, when the intensity of vibration is low, it is possible to allow vibration to converge while minimizing an output decrease of the steam turbine 1 by switching the minimum number of the valves 72 on the opening state.

In the configuration, because the valve 72 which is a movable part can be provided outside the casing 2, it is possible to perform maintenance without opening the inside of the casing 2. On the other hand, when the valve 72 is provided inside the casing 2, it is necessary to access the inside of the casing 2. In order to access the inside of the casing 2, it is necessary to stop the operation of the steam turbine 1, and then wait for a long period of time until an internal temperature of the casing 2 decreases. That is, an operation downtime of the steam turbine 1 extends over a long period of time. However, according to the configuration, it is possible to easily perform maintenance of the steam turbine 1 by only opening and closing the valve 72.

The first embodiment of the present invention has been described above. Various forms of modifications or improvements can be made to the configuration without departing from the spirit of the present invention. In the example of the embodiment, four jet flow passages 70 and four valves 72 are disposed in the peripheral direction. However, the number of the jet flow passages 70 and the number of valves 72 are not limited to four, and may be greater than or equal to five. Desirably, the number of the jet flow passages 70 and the valves 72 is an even number from the viewpoint of a uniform peripheral pressure distribution.

In the example of the embodiment, the control device 90 executes Steps S1 and S2 shown in FIG. 7A. However, the operation of the control device 90 is not limited to the operation described above, and the control device 90 can execute an operation shown in FIG. 7B, which is another example.

Figure 7B:
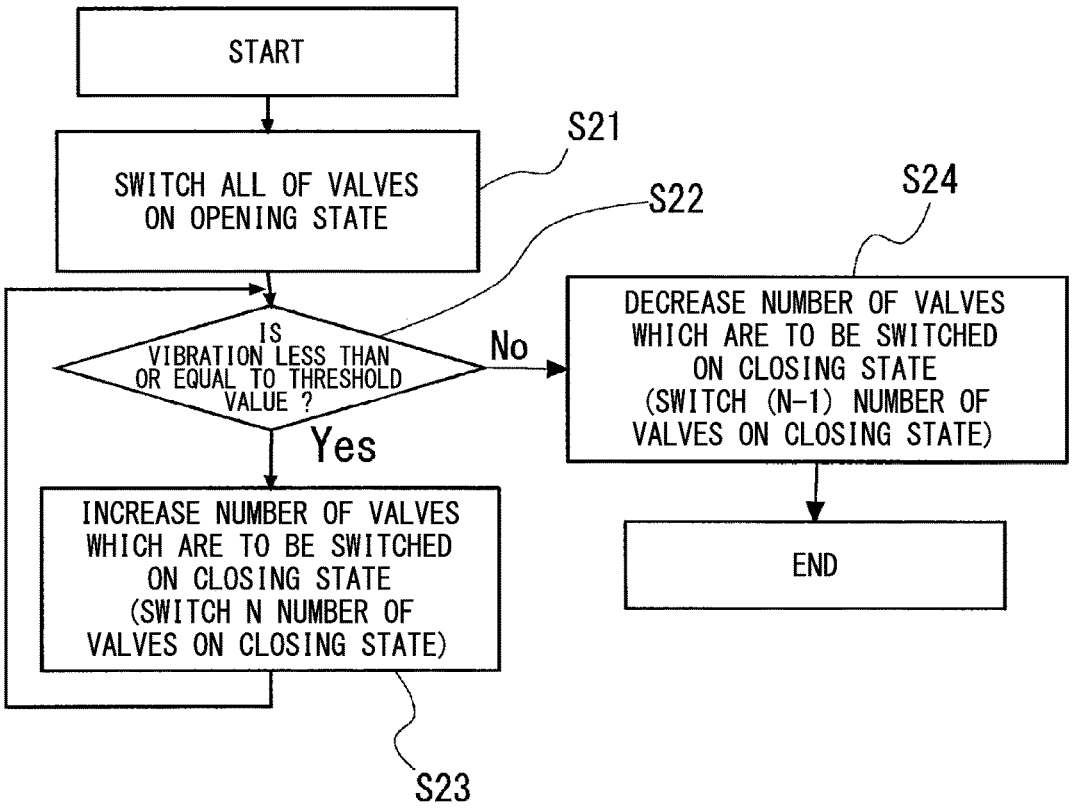
FIG. 7B is a flowchart showing a process performed by a control device according to a modification example of the first embodiment of the present invention.

In the example of FIG. 7B, regardless of whether vibration occurs, the control device 90 switches all of the valves 72 on the opening state at the beginning (Step S21). Subsequently, the determination unit 83 compares a vibration intensity of the rotor 3 with the threshold value (Step S22). When the determination unit 83 determines that the vibration intensity is less than or equal to the threshold value (Step S22: Yes), the control device 90 (the driving control unit 84) switches only a predetermined n number of the valves 72 on the closing state (Step S23). Desirably, the value of n is appropriately determined in response to an operation record or output of the steam turbine 1.

After Step S23 is executed, the determination unit 83 compares the vibration intensity with the threshold value again. When the determination unit 83 determines that the vibration intensity is greater than or equal to the threshold value (Step S22: No), it is possible to consider the determination result as a recurrence of vibration of the rotor 3 due to a large number of the valves 72 being switched on the closing state in Step S23. The control device 90 (the driving control unit 84) reduces the number of the valves 72 by one, which are to be switched on the closing state. That is, one valve 72 is maintained on the opening state such that (n−1) number of the valves 72 are in the closing state (Step S24).

According to the embodiment, it is possible to switch only the number of the valves 72 on the opening state which are required to restrict the vibration of the rotor 3. That is, it is possible to realize an operation condition with high accuracy, under which it is possible to minimize an output decrease of the steam turbine 1 while decreasing the vibration of the rotor 3.

In the embodiment, the steam turbine 1 is an example of a rotary machine. However, the form of the rotary machine is not limited to the steam turbine 1, and the rotary machine may be a centrifugal compressor or a gas turbine.

Second Embodiment

Figure 8:
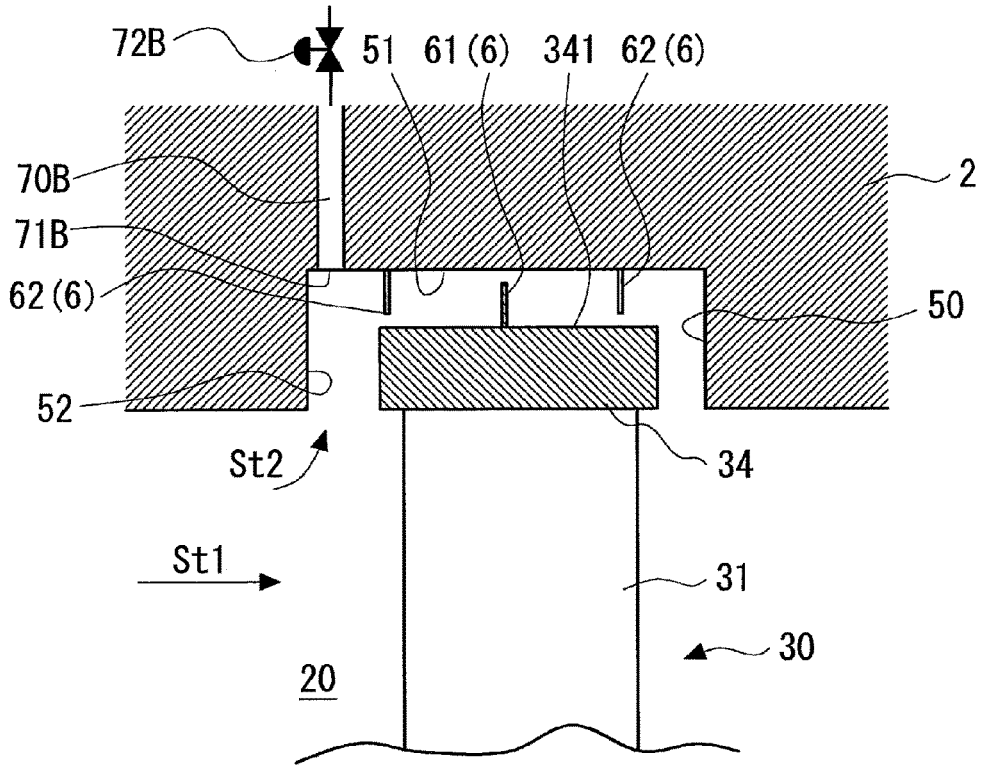
FIG. 8 is an enlarged view of a jet flow passage according to a second embodiment of the present invention.

Subsequently, a second embodiment of the present invention will be described with reference to FIG. 8. The same reference signs will be assigned to the same components as in the first embodiment, and detailed descriptions thereof will be omitted. As shown in the same drawing, in the embodiment, a jet flow passage 70B is formed in the recessed portion bottom surface 51, and extends in the radial direction with respect to the axis O. The first end (jet outlet 71B) of the jet flow passage 70B opens tangent to an upstream edge of the recessed portion bottom surface 51.

Figure 9:
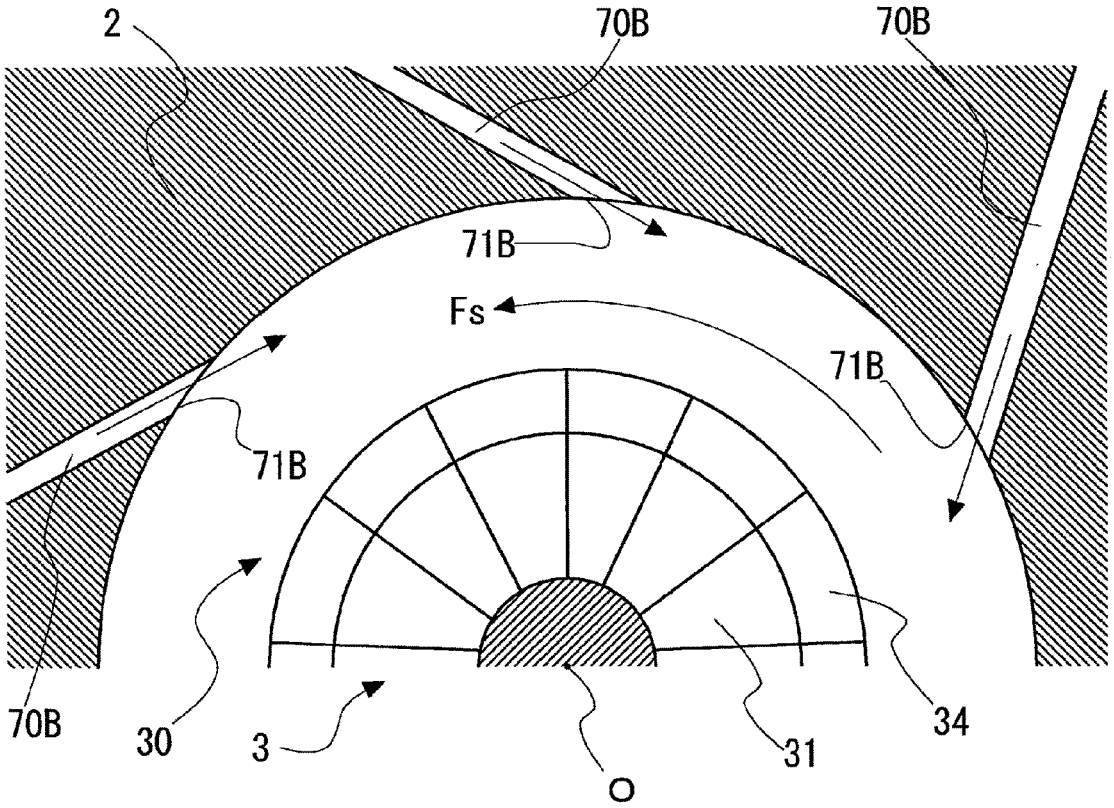
FIG. 9 is a view of the jet flow passage according to the second embodiment of the present invention as seen in the axial direction.

As shown in FIG. 9, similar to the first embodiment, also in the embodiment, a plurality of the jet flow passages 70B are provided inside the recessed portion 50 while being equally spaced from each other in the peripheral direction. Each of the jet flow passages 70B extends rearward in the rotation direction of the rotor 3 from the outside to the inside in the radial direction with respect to the axis O.

A valve 72B is provided at the second end of the jet flow passage 70B. The valve 72B switches a flow condition of the jet flow passage 70B via switching between the opening state and the closing state. Specifically, the valve 72B is an electromagnetic valve. A fluid (steam, air, or the like) supplied from a supply source (not shown) flows through the jet flow passage 70B.

The swirl component is formed inside the recessed portion 50 such that the swirl component flows frontward in the rotation direction as travelling from one side to the other side in the direction of the axis O along with the rotation of the rotor 3. In the configuration, the fluid jetted out of the first end of the jet flow passage 706 flows rearward in the rotation direction as travelling from the outside to the inside in the radial direction. That is, the fluid is jetted out of the jet flow passage 70B in a direction intersecting a flow direction of the swirl component. Therefore, it is possible to effectively decrease the swirl component.

The second embodiment of the present invention has been described above. Various forms of modifications or improvements can be made to the configuration without departing from the spirit of the present invention. In the embodiment, the steam turbine 1 is an example of a rotary machine. However, the form of the rotary machine is not limited to the steam turbine 1, and the rotary machine may be a centrifugal compressor or a gas turbine.

Third Embodiment

Figure 10:
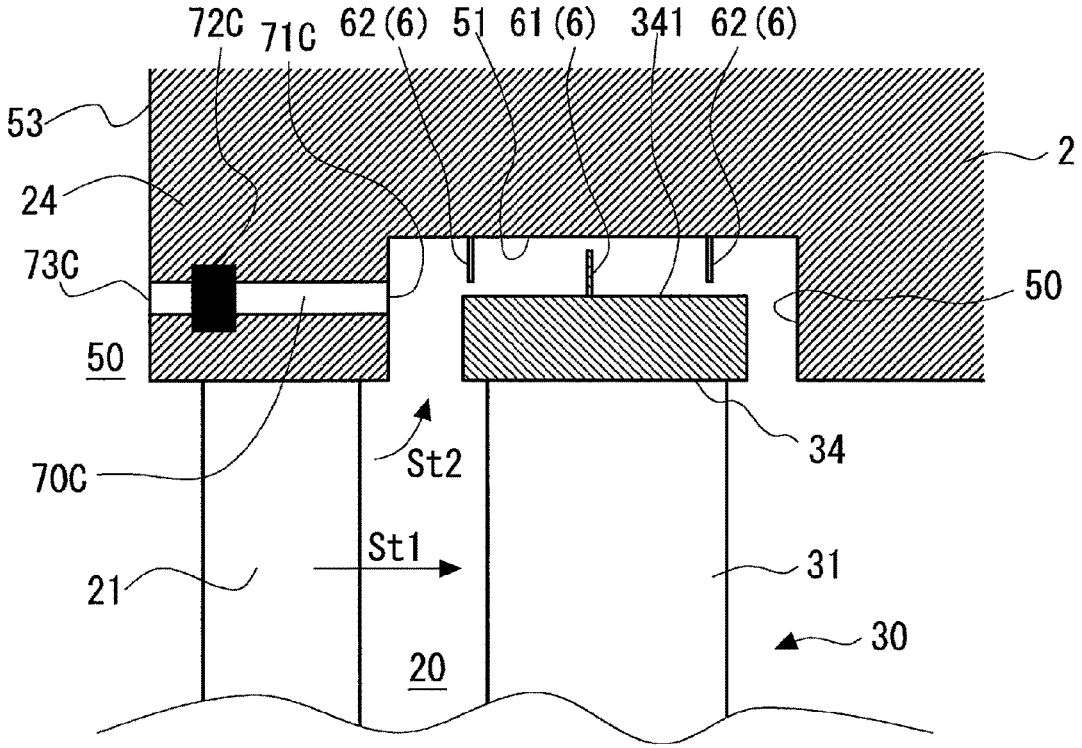
FIG. 10 is a view of a jet flow passage according to a third embodiment of the present invention as seen in the radial direction.

Subsequently, a third embodiment of the present invention will be described with reference to FIG. 10. The same reference signs will be assigned to the same components as in the embodiments, and detailed descriptions thereof will be omitted. As shown in the same drawing, in the embodiment, a pair of the recessed portions 50 adjacent to each other in the direction of the axis O communicate with each other via a jet flow passage 70C. The first end (jet outlet 71C) of the jet flow passage 70C opens in the recessed portion upstream surface 52 of the recessed portion 50, which is positioned relatively downstream in the direction of the axis O. The second end (suction port 73C) of the jet flow passage 70C opens in the recessed portion downstream surface 53 of the recessed portion 50, which is positioned relatively upstream in the direction of the axis O. That is, the jet flow passage 70C passes through the stator blade base 24 in the direction of the axis O.

Figure 11:
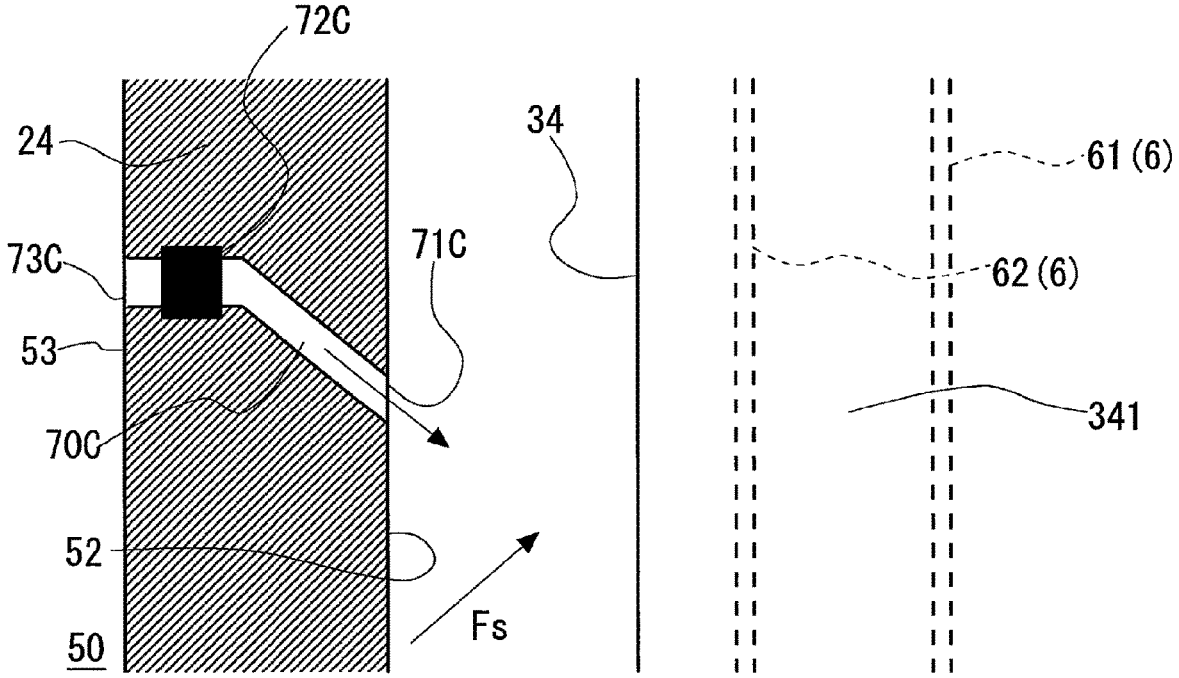
FIG. 11 is a cross-sectional view of a steam turbine according to the third embodiment of the present invention.

As shown in FIG. 11, a portion of the jet flow passage 70C, which contains the jet outlet 71C, extends rearward in the rotation direction of the rotor 3 and from the upstream side to the downstream side. A portion of the jet flow passage 70C, which contains the suction port 73C, extends in the direction of the axis O, and a valve 72C is provided in the middle of the portion of the jet flow passage 70C. The valve 72C switches a flow condition of the jet flow passage 70C via switching between the opening state and the closing state. Specifically, the valve 72C is an electromagnetic valve. A fluid (steam, air, or the like) supplied from a supply source (not shown) flows through the jet flow passage 70C.

The swirl component is formed inside the recessed portion 50 such that the swirl component flows frontward in the rotation direction as travelling from one side to the other side in the direction of the axis O along with the rotation of the rotor 3. In the configuration, the fluid jetted out of the first end of the jet flow passage 70C flows rearward in the rotation direction as travelling from one side to the other side in the direction of the axis O. That is, the fluid is jetted out of the jet flow passage 70C in a direction intersecting a flow direction of the swirl component. Therefore, it is possible to effectively decrease the swirl component.

In the steam turbine 1, high-pressure steam is supplied from one side (upstream side) in the direction of the axis O. For this reason, the closer a portion of the recessed portion 50 is positioned to one side in the direction of the axis O, the higher a pressure of flowing steam is. Therefore, in the configuration, between a pair of the recessed portions 50 adjacent to each other, high-pressure steam in the recessed portion 50 on one side in the direction of the axis O can be jetted to the recessed portion 50 on the other side in the direction of the axis O via the jet flow passage 70C. That is, it is not necessary to provide a separate pressure source or the like for the jetting of the fluid out of the jet flow passage 70C. Therefore, it is possible to simplify the configuration of the apparatus.

The third embodiment of the present invention has been described above. Various forms of modifications or improvements can be made to the configuration without departing from the spirit of the present invention. In the embodiment, the steam turbine 1 is an example of a rotary machine. However, the form of the rotary machine is not limited to the steam turbine 1, and the rotary machine may be a centrifugal compressor or a gas turbine.

While preferred embodiments of the invention have been described and shown above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

EXPLANATION OF REFERENCES

1: steam turbine
2: casing
3: rotor
4: journal bearing
5: thrust bearing
6: sealing fin
11: shaft end
12: steam supply pipe
13: steam exhaust pipe
20: main flow passage
21: stator blade
22: stator blade shroud
24: stator blade base
30: rotor blade
31: blade body
34: rotor blade shroud
50: recessed portion
51: recessed portion bottom surface
52: recessed portion upstream surface
53: recessed portion downstream surface
61: shroud side sealing fin
62: recessed portion side sealing fin
70, 70B, 70C: jet flow passage
71, 71B, 71C: jet outlet
72, 72B, 72C: valve
73C: suction port
80: vibration sensor
81: controller
82: vibration detection unit
83: determination unit
84: driving control unit
90: control device
91: CPU
92: ROM
93: RAM
94: HDD
95: signal receiving module
L: signal line
O: axis
St1: main steam
St2: leakage flow

What is claimed is:

1. A rotary machine comprising:

a rotary shaft configured to rotate in a rotation direction around an axis;

a plurality of rotor blades extending outward from the rotary shaft in a radial direction of the rotary shaft and are provided with gaps therebetween in a peripheral direction of the rotary shaft;

a casing surrounding the rotor blades radially outside the rotor blades, and in which a recessed portion as a cavity accommodates tips of the rotor blades;

a sealing portion extending from one of a bottom surface of the recessed portion and the tip of the rotor blade, and having a clearance with the other;

a jet flow passage through which a fluid is jetted rearward relative to the rotation direction as travelling from one side to another side in a direction of the axis;

a valve which is capable of switching a flow condition of the jet flow passage with turning the valve to an opening state and a closing state;

a vibration detection unit configured to detect vibration of the rotary shaft; and a control device configured to switch the valve to the opening state when the vibration of the rotary shaft is detected by the vibration detection unit and to maintain the valve in the closing state when the vibration of the rotary shaft is not detected, wherein a plurality of the jet flow passages and a plurality of the valves are provided while being equally spaced from each other in the peripheral direction with respect to the axis, and wherein the control device determines the number of the valves to be switched to the opening state in response to an intensity of vibration of the rotary shaft.

2. The rotary machine according to claim 1, wherein the jet flow passage extends rearward in the rotation direction of the rotary shaft along with the jet flow passage moves on from one side to the other side in a direction of the axis, and a first end of the jet flow passage is opened in a recessed portion upstream surface which is positioned on an upstream side of the recessed portion.

3. The rotary machine according to claim 1, wherein the jet flow passage extends rearward in the rotation direction of the rotary shaft and from the outside to an inside in the radial direction, and a first end of the jet flow passage opens in the bottom surface of the recessed portion.

4. The rotary machine according to claim 1, wherein a plurality of the recessed portions are formed in the casing so as to be arranged spaced from each other in the axial direction, and a second end of the jet flow passage is opened in one of a pair of the recessed portions that are adjacent to each other, which is positioned on one side in the axial direction, and the first end of the jet flow passage is opened in the other of the pair of the recessed portions, which is positioned on the other side in the axial direction.

5. The rotary machine according to claim 1, wherein, the control device increases the number of the valves which are turned to the opening state with the increasing of the intensity of vibration of the rotary shaft, and turns the valves to the opening state such that a plurality of the jet flow passages, which are in opening conditions, are equally spaced from each other in the peripheral direction.

6. The rotary machine according to claim 1, wherein the jet flow passage is arranged such that the fluid is jetted out through the jet flow passage in a direction intersecting a flow direction of a swirl component being formed along the rotation of the rotor.

* * * * *